US005638738A

United States Patent [19]

Sell

[11] Patent Number: 5,638,738

[45] Date of Patent: Jun. 17, 1997

[54] AIR MOTOR PISTON TO CRANK LINKAGE

[75] Inventor: Leslie J. Sell, Bothell, Wash.

[73] Assignee: Ingersoll-Rand Company, Woodcliff Lake, N.J.

[21] Appl. No.: 590,986

[22] Filed: Jan. 24, 1996

[51] Int. Cl.[6] ..... F01B 9/00

[52] U.S. Cl. ..... 92/138; 92/147; 74/44

[58] Field of Search ..... 74/44; 92/138, 92/147

[56] References Cited

U.S. PATENT DOCUMENTS

| | | | |
|---|---|---|---|
| 190,938 | 5/1877 | Warrick et al. | 92/138 |
| 545,032 | 8/1895 | Wood . | |
| 669,290 | 3/1901 | Stoer | 92/138 |
| 887,855 | 5/1908 | Sharpneck | 92/138 |
| 947,882 | 2/1910 | Batchelder . | |
| 1,386,753 | 8/1921 | Baer | 92/138 |
| 1,523,790 | 1/1925 | Pedersen | 92/138 |
| 1,727,049 | 9/1929 | Cobb | 92/138 |
| 3,657,972 | 4/1972 | Strebel et al. . | |
| 3,839,946 | 10/1974 | Paget | 92/153 |
| 4,230,026 | 10/1980 | Hartley . | |
| 4,381,903 | 5/1983 | Atkins . | |
| 4,729,291 | 3/1988 | Miller . | |
| 4,756,674 | 7/1988 | Miller . | |
| 4,762,051 | 8/1988 | Besic et al. . | |
| 4,931,000 | 6/1990 | Fleming . | |
| 5,123,334 | 6/1992 | van Loo . | |
| 5,259,256 | 11/1993 | Brackett . | |
| 5,351,567 | 10/1994 | Brackett . | |
| 5,375,566 | 12/1994 | Brackett . | |
| 5,417,309 | 5/1995 | Brackett . | |
| 5,431,130 | 7/1995 | Brackett . | |
| 5,445,039 | 8/1995 | Brackett . | |
| 5,456,159 | 10/1995 | Brackett . | |

*Primary Examiner*—Thomas E. Denion
*Attorney, Agent, or Firm*—Walter C. Vliet

[57] ABSTRACT

An air motor for hoists and the like utilizes opposed pistons interconnected by a rigid yoke having a single pivot link for each piston pair connected to the crank by means of standard press fit bearings which maintain yoke and piston alignment with the crank in oil free operation.

7 Claims, 2 Drawing Sheets

AIR MOTOR PISTON TO CRANK LINKAGE

BACKGROUND OF THE INVENTION

This invention relates generally to air motors and more particularly to a piston to crank linkage for an air motor for a hoist.

In a reciprocating piston air motor the usual method of transferring the force of each piston to the crank shaft is through a connecting rod, one end of which pivots on a wrist pin in the piston, the other end being connected by a bearing assembly to the crank shaft. This arrangement is called a linked piston motor.

Linked piston air motors utilize one of two well known bearing arrangements for connecting the piston rods to the crank shaft. In both of these arrangements the crank shaft has a single journal to which the rods are connected at the same axial location or, in the case of six piston motors, at two adjacent axial locations.

In the common bearing arrangement the rod ends are segmented so that together they form a complete bearing that encircles the crankshaft journal. The segmented rod ends have sufficient clearance between adjacent rod ends to allow the rods to pivot independently and are held against the journal by retaining rings that encircle the outside of the segments.

In the second bearing arrangement one of the connecting rods, known as the "Queen Rod" contains a bearing that fits over the crankshaft journal. The bearing housing on this rod has a flange around the outside to which the remainder of the rods are pinned.

In order to accommodate the frictional resistance from side loading of the connecting rods, the pistons of these motors require sufficient skirt length to prevent them from tipping and jamming in the cylinder bore. The ratio of piston length to diameter is usually greater than 0.6, adding significantly to the size and inertia of the moving parts. This results in an air motor that is large in comparison to its power output. Because of the requirement to pin the rods outside of the crank bearing, the "Queen Rod" air motor requires even greater space.

A well known alternative that overcomes the size and inertia problems of the linked piston motor is the "Scotch Yoke" piston motor. In this motor, pairs of opposing pistons are yoked together and their force is transferred to a bearing on the crank that rides back and forth in a slot in the yoke. With the pistons yoked together their effective bearing length is increased to the distance across the motor between one opposing piston and the other. This allows the pistons to be very short in comparison to their diameter, their length need only be great enough to accommodate a sealing ring that can also be designed to handle the side loads. The method of transferring the piston force through a bearing riding in a slot in the yoke requires the bearing to reverse rotation every 90 degrees of crank rotation. For this reason, the yoke must be hardened steel to withstand the wear caused by the bearing scuffing at high speeds. An additional bearing arrangement is usually required to prevent the yoke from twisting on its axis which would throw it out of perpendicular alignment with the crank pin.

With the exception of the "Queen Rod" arrangement, these motors require oil bath lubrication in the crankcase to prevent wear of the crank bearings and remove frictional heat. The "Queen Rod" motor could be designed to utilize sealed anti-friction bearings and therefore avoid the need for oil bath lubrication but this would also increase overall size.

The present invention combines the principles of the "Queen Rod" and "Scotch Yoke" arrangements in a novel way to provide a piston and crank linkage that is light and compact and does not require oil bath lubrication.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF INVENTION

In one aspect of the present invention this is accomplished by providing an air motor piston to crank linkage comprising a pair of opposed pistons disposed in opposed cylinder chambers for reciprocation therein and interconnected by a planer open center rigid yoke; a crank having a crank connection rotating within the confines of the open center of the yoke; and a pivot link connecting one of the pair of opposed pistons to the crank connection.

The foregoing and other aspects of the invention will become apparent from the following detailed description of the invention when considered in conjunction with the accompanying drawing figures.

BRIEF DESCRIPTION OF THE DRAWING FIGURES

FIG. 1 shows a front elevation view of a yoked piston pair according to the present invention engaging cylinders at each side of the motor; and FIG. 2 is a top sectional view of the yoke and link taken at Section 2-2 of FIG. 1.

DETAILED DESCRIPTION

Figure 1:
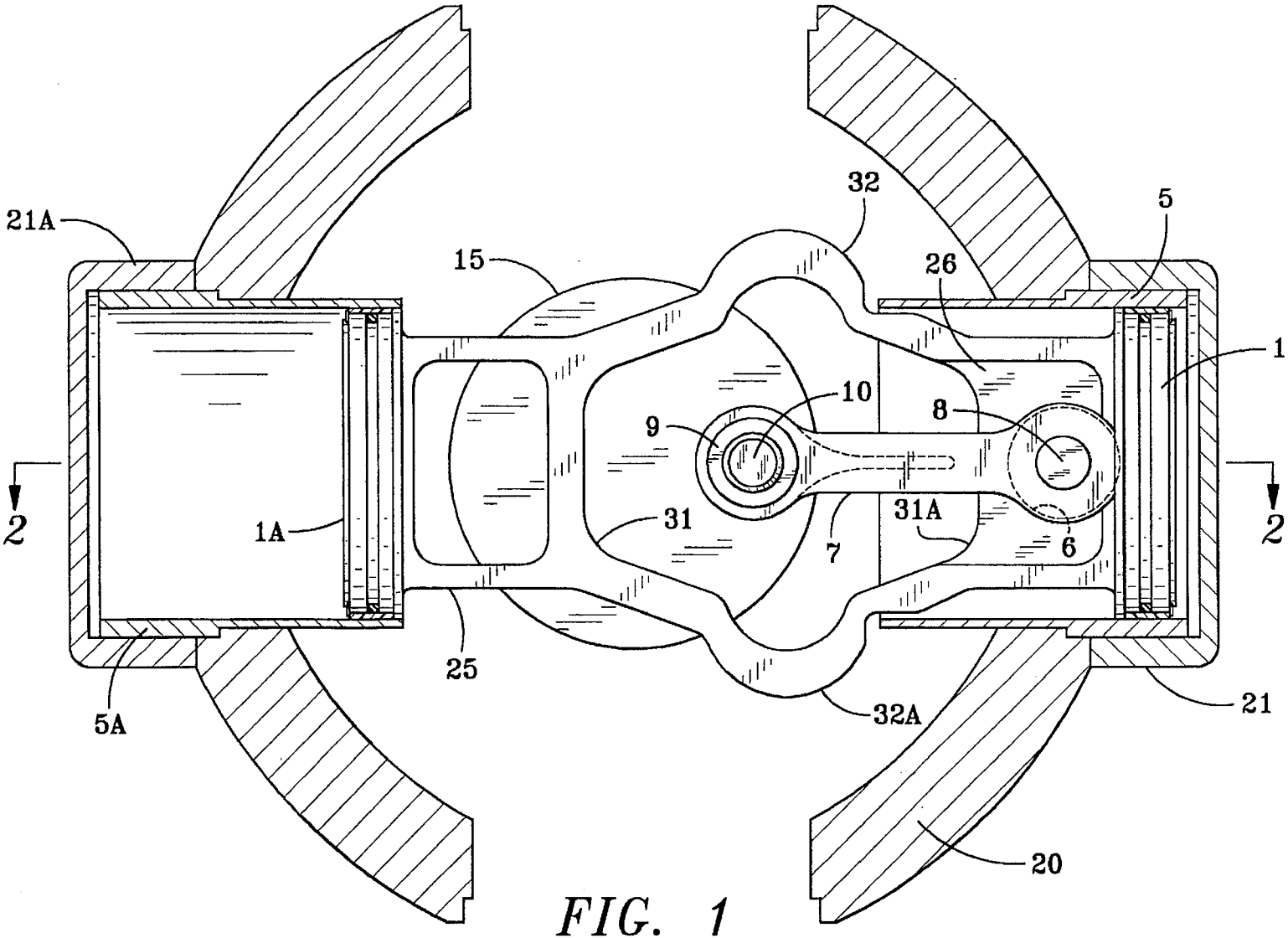
Figure 2:
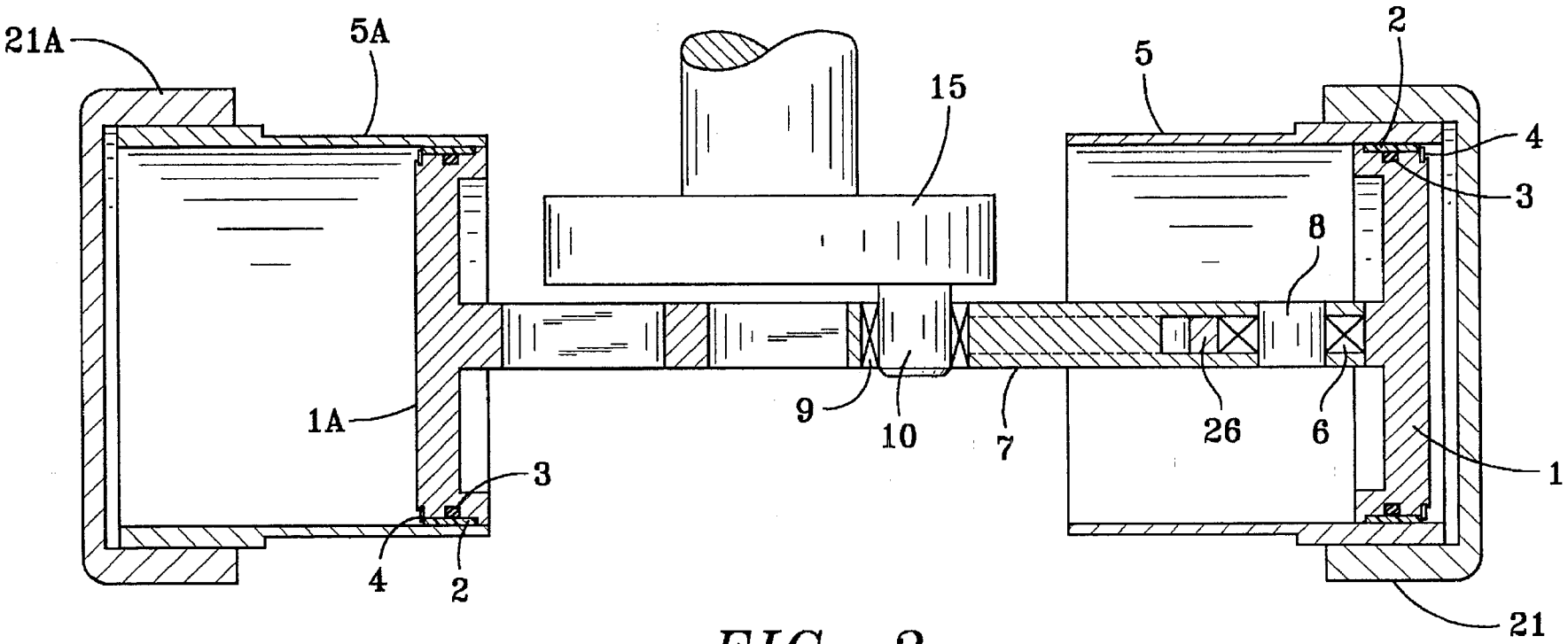

Referring to FIGS. 1 and 2, an air motor for a winch or the like is shown including a motor body 20 having cylinder caps 21 and 21A installed at opposite ends to form opposed piston cavities. In this arrangement, pairs of pistons 1 and 1A (or multiple pairs of pistons axially offset and/or radially offset as, for example, 90° for a four cylinder radial motor) are yoked together to provide great bearing length (i.e., the distance between the pistons) but their force is transferred to the crank 15 through a single pivoting link 7 attached to one end of the yoke 25. Since two pistons 1 and 1A share the same link, the number of bearings required for the link is half that of a motor with conventional connecting rods. As in the "Scotch Yoke" arrangement, the pistons require only sufficient length for a seal ring that also acts as a bearing to support the side load.

"The pistons 1 and 1A are linked together by an open center rigid yoke 25. The open center 30 provides clearance for the crank pin 10 to rotate in and translate along an arc relative to the yoke 25 as defined by the pivoting link 7 about pin 8. The open center or clearance opening 30 is in the form of opposed trapezoidal openings 31 and 31A connected by semicircular bridges 32 and 32A on the top and bottom as shown in FIG. 1 to form a continuous sided opening."

The pre-lubricated and sealed bearings 6 and 9 are used to pivot the link. The bearings are standard items requiring no further crankcase lubrication. These bearings also act to prevent the yoke from twisting on its axis.

The yoke 25 and pistons 1 and 1A are cast as a single piece from aluminum or other suitable structural material. Each piston includes a plastic seal ring 2 which also acts as a piston support bearing. Seal ring 2 is backed by O-ring 3 to effect resilient sealing pressure on the seal ring and is held on the piston by retaining ring 4. Each piston 1 and 1A slideably engages its respective cylinder 5 and 5A. Sealed bearing 6 is pressed into yoke 1. Link 7 is pinned through sealed bearing 6 by pin 8 through web 26 of yoke 25. Link 7 also contains sealed bearing 9 that engages crank pin 10.

Sealed bearing 6 is a standard deep groove ball bearing that is pressed into the yoke with sufficient interference to reduce its internal clearance. In this condition the bearing provides a high degree of stiffness to the link to prevent it from twisting and to eliminate any tendency for axial movement on the yoke. When the yoke is assembled with a needle roller bearing 9 engaging the crank pin 10, this stiffness is transferred to the yoke to prevent the entire assembly from twisting on its axis. This permits the connecting yoke and assembly to be manufactured with a minimum axial length piston, minimum yoke depth and minimum adjacent piston offset for multiple radial piston sets, which in turn results in the ability to manufacture compact motors with minimum diameter and axial crank length dimensions. Several pairs of pistons may be arranged in so-called "pancake" form (opposed 2 cylinder, 4 cylinder, 6 cylinder, etc.) or in "radial" form (4, 6, 8 cylinder, etc.).

Having described my invention in terms of a preferred embodiment, I do not wish to be limited in the scope of my invention except as claimed.

What is claimed is:

1. An air motor piston to crank linkage comprising:

a pair of opposed pistons disposed in opposed cylinder chambers for reciprocation therein and interconnected by a planer open center rigid yoke having a continuous sided open center; and a pivot link and a crank having a crank to pivot link connection rotating about said crank and in the confines of said open center of said open center rigid yoke add translating relative to said open center rigid yoke along an arc segment as defined by said pivot link connecting one of said pair of opposed pistons to said crank connection.

2. An air motor piston to crank linkage according to claim 1, wherein:

said open center rigid yoke is provided with a pivot link clearance opening.

3. An air motor piston to crank linkage according to claim 2, wherein:

said clearance opening is a continuous sided opening in the form of opposed trapezoidal openings connected by a semi-circular bridge on each side.

4. An air motor piston to crank linkage according to claim 2, wherein:

said yoke is further provided with a yoke web for yoke stiffening.

5. An air motor piston to crank linkage according to claim 4, wherein:

said pivot link is connected to said web formed on said yoke by means of a pressed in bearing and pressed in pin arrangement.

6. An air motor piston to crank linkage according to claim 1, wherein:

said pivot link is connected to said crank connection through a pressed in bearing in said pivot link.

7. An air motor piston to crank linkage according to claim 6, wherein:

said pressed in bearing is a sealed needle bearing.

* * * * *